United States Patent [19]

Fulks

[11] Patent Number: 4,789,367

[45] Date of Patent: Dec. 6, 1988

[54] MARINE ENGINE FLUSHING AND EMERGENCY BILGE PUMPING ASSEMBLY

[76] Inventor: Jack Fulks, 4300 Cutlass La., Naples, Fla. 33940

[21] Appl. No.: 130,095

[22] Filed: Dec. 7, 1987

[51] Int. Cl.[4] ..... B63B 13/00

[52] U.S. Cl. ..... 440/88; 114/183 R

[58] Field of Search ..... 114/183 R; 440/1, 2, 440/88; 137/554; 123/41.01, 41.28, 41.44, 41.47, 41.74

[56] References Cited

U.S. PATENT DOCUMENTS

| | | | |
|---|---|---|---|
| 1,769,136 | 7/1930 | Hepburn | 114/183 R |
| 2,350,598 | 6/1944 | Faville | 440/88 |
| 3,550,612 | 12/1970 | Maxon | 440/88 |
| 3,896,280 | 7/1975 | Blake | 137/554 |
| 3,946,694 | 3/1976 | Belsky | 114/183 R |

*Primary Examiner*—Joseph F. Peters, Jr.
*Assistant Examiner*—Edwin L. Swinehart
*Attorney, Agent, or Firm*—Merrill N. Johnson

[57] ABSTRACT

An assembly for a boat having an internal combustion engine which uses sea water as its coolant and a bilge which collects sea water. The assembly comprises a Y-shaped pipe whose tail is connected to the water pump of the internal combustion engine, a first manually operable on-off valve for controlling the flow of sea water into the water pump located in one arm of the Y-shaped pipe, a second manually operable on-off valve for controlling the flow of an alternative source of water into the water pump located in the second arm of the Y-shaped pipe, and a length of flexible hose attached to the end of the second arm of the Y-shaped pipe, the free end of said hose being alternatively connectable to a source of fresh water or to the sea water in the bilge. The assembly may include a switch mounted on the Y-shaped pipe whenever the on-off valve between the engine's water pump and the hose leading to the sea is closed. This switch controls a red warning light mounted on the boat's console to give a visual warning to the boat operator that the connection between the sea water and the engine's water pump, which is normally open, is closed.

1 Claim, 1 Drawing Sheet

MARINE ENGINE FLUSHING AND EMERGENCY BILGE PUMPING ASSEMBLY

BACKGROUND AND SUMMARY OF THE INVENTION

My invention relates to boats having water cooled internal combustion engines. In particular, my invention provides for flushing the cooling system of a marine engine with fresh water and also provides an emergency bilge water pumping system.

Marine internal combustion engines are conventionally cooled by water drawn from the sea in which the boat operates. Sea water contains salt, other minerals, sand and other impurities which are harmful to the engine and its accessories particularly if the sea water is permitted to remain in the engine's cooling system for extended periods of time, as when the boat is docked or stored.

It is recommended that the engine's cooling system be flushed with fresh water during extended periods of docking or storage and various apparatus for flushing have been suggested. See, for example, U.S. Pat. Nos. 3,550,612 and 4,619,618.

In addition, boats conventionally include an electrically operated bilge pump which is intended to automatically pump out sea water which tends to accumulate during operation of the boat. However, automatic bilge pumps are notoriously unreliable and it is often necessary to adopt emergency measures to resort to alternative arrangements to replace or supplement the regular bilge pumping system. Various auxilliary systems have been proposed to supplement the regular bilge pump. See, for example, U.S. Pat. No. 3,946,694.

My invention provides a simple, low cost and easy to install assembly which can be used to flush the sea water out of the cooling system of a marine internal combustion engine installed in a boat and which also can be used as an emergency or auxilliary bilge pump-out system using the engine's water pump.

In its simplest form, my unique assembly consists of a Y-shaped pipe whose tail is connected to the water pump of the internal combustion engine, a first manually operable on-off valve for controlling the flow of sea water into the water pump located in one arm of the Y-shaped pipe, a second manually operable on-off valve for controlling the flow of an alternative source of water into the water pump located in the second arm of the Y-shaped pipe, and a length of flexible hose attached to the end of the second arm of the Y-shaped pipe, the free end of said hose being alternatively connectable to a source of fresh water or to the sea water in the bilge.

In order to warn the boat's operator not to operate the boat's internal combustion engine unless there is an adequate source of water to be pumped through the engine's cooling system, my assembly can include a switch mounted on the Y-shaped pipe which is activated whenever the on-off valve between the engine's water pump and the hose leading to the sea is closed. This switch controls a red warning light mounted on the boat's control panel to give a visual warning to the boat operator that the normally open connection between the sea water and the engine's water pump is closed.

DETAILED DESCRIPTION OF THE PREFERRED EMBODIMENT

Figure 1:
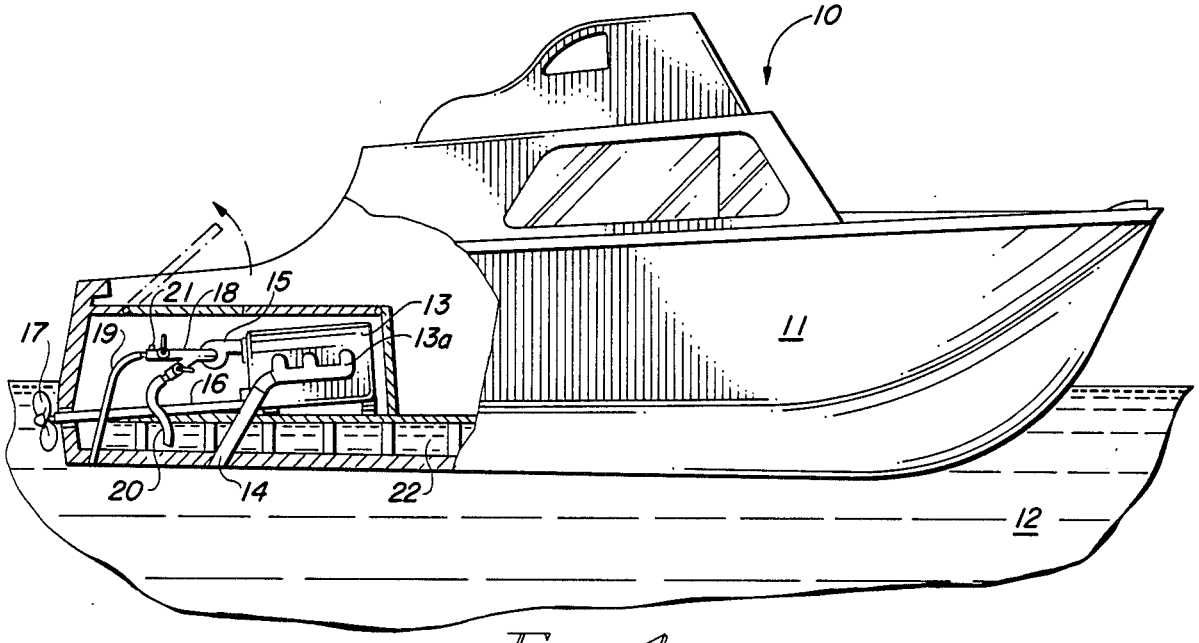
FIG. 1 is a side elevational view of a boat with the boat's hull partially broken away to show a schematic representation of my assembly connected to the water pump of the boat's internal combustion engine.

Referring first to FIG. 1 of the drawing, a power boat 10 having a hull 11 is floating in seawater 12. In FIG. 1 the stern of hull 11 is broken away to show schematically an internal combustion marine engine 13 having an exhaust manifold 13*a* vented into the sea by exhaust pipe 14. Operation of engine 13 rotates drive shaft 16 and propeller 17 whose rotation drives the boat.

Marine engine 13 is cooled by water forced through the engine by water pump 15. Conventionally the water used for cooling engine 13 is sea water drawn into the water pump 15 from a line running from the bottom of the boat directly into water pump 15. However, in accordance with my invention Y-shaped assembly 18 is connected to the water pump.

Figure 2:
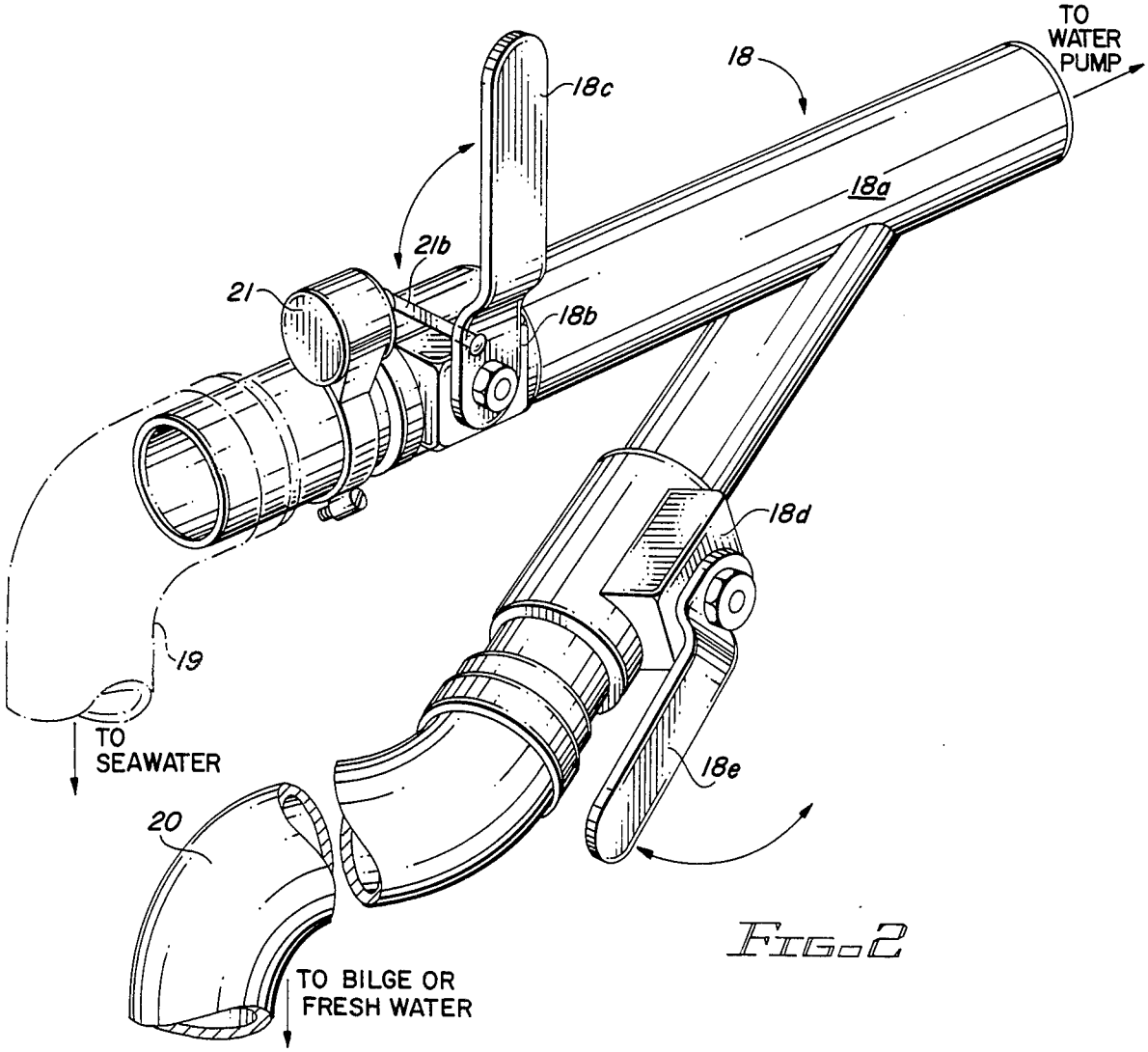
FIG. 2 is a perspective view of a preferred embodiment of my assembly for use in the schematic representation shown in FIG. 1.

The construction and operation of assembly 18 are best understood by reference to FIG. 2 of the drawing. Assembly 18 is a preferably Y-shaped pipe 18*a* whose open ended tail is connected to the intake port of water pump 15. Each arm of pipe 18*a* contains a manually operable on-off valve 18*b* or 18*d*. Each of valves 18*b* and 18*d* includes a hand operated lever shown as 18*c* and 18*e* respectively. Moving levers 18*c* and 18*d* 90° turns valves 18*b* and 18*d* from fully on to fully off.

An on-off electrical switch is securely mounted on pipe 18*a* adjacent valve 18*b*. Switch 21 includes a spring loaded arm 21*b*. Switch arm 21*b* is connected to lever 18*c* in such a manner that when the lever is moved from vertical "on" position as shown in FIG. 2 to horizontal "off" position, switch 21 is activated.

The open end of pipe 18*a* adjacent valve 18*b* and relay switch 21 is connected to pipe 19 whose other end opens to the sea beneath the boat. With lever 18*c* in its vertical "on" position shown in FIG. 2, the line from the sea to water pump 15 is open and operation of the pump will draw sea water into engine 13 to cool the engine during its operation.

When the boat is not being used on a daily basis or is to be stored, it is desirable to flush out the water passageways of engine 13 with fresh water to prevent the corrosive effects of the sea water from damaging the engine and the water pump itself. To do this, valve 18*b* is closed by hand operation of lever 18*c* turning it 90° from vertical to horizontal position. In so doing, lever 18*c* moves arm 21*b* moving the arm from "off" to "on" position. This causes relay switch 21 to send a signal to a red warning light (not shown) mounted on the control panel of the boat to warn the boat's operator that sea water is not flowing into the engine and that the engine should not be operated.

By now turning lever 18*e* from normally "off" position as shown in FIG. 2 by 90° to "on" position valve 18*d* is opened and fresh water from flexible hose 20 can now be fed to water pump 15 and into the water passageways in engine 13 to flush out the water pump and engine with fresh water.

My assembly 18 can also be used on boat 10 as an emergency bilge pump. It is well known that the conventional bilge pump used to expell sea water which tends to accumulate in the bilge of the boat often fails and in times of high seas or other unfavorable conditions, failure of the regular bilge pump can result in swamping of the boat.

Assembly 18 can be used as an emergency bilge pump by first closing valve 18*b*, then opening valve 18*d* and inserting flexible hose 20 into the boat's bilge 22 as shown in FIG. 1 of the drawing. Operation of water pump 15 and engine 13 will draw water from the bilge, thus keeping the bilge water from rising to dangerous levels.

While I have shown and described a preferred form of my marine engine flushing and emergency bilge pump assembly, it will be apparent to those skilled in the art to make various rearrangements and modifications without departing from the spirit and scope of my intention. Therefore no limitation should be implied from the foregoing description since the scope of my invention is limited only by the appended claims.

I claim:

1. An assembly for a boat having a bilge and an internal combustion engine which has a water pump using sea water as its coolant comprising a Y-shaped pipe having a tail and two arms, the tail of which is connected to the engine's water pump, a first manually operable on-off valve located in one arm of the Y-shaped pipe, said valve being opened and closed by a hand-operated lever, for controlling the flow of sea water into the engine's water pump, a second manually operable on-off valve located in the other arm of the Y-shaped pipe, said valve being opened and closed by a hand operated lever, for controlling the flow of fresh water and water from the bilge into the engine's water pump, a flexible hose connected to the open end of the second arm of the Y-shaped pipe for flushing the engine with fresh water and for removing water from the bilge, and an on-off electrical switch mounted on the first arm of the Y-shaped pipe adjacent to the first on-off valve, said switch having a spring loaded arm which is moved from off to on position by movement of the valve's lever from open to closed position.

* * * * *